US005803242A

United States Patent [19]

Takano et al.

[11] Patent Number: 5,803,242

[45] Date of Patent: Sep. 8, 1998

[54] SWITCH CONNECTING STRUCTURE

[75] Inventors: Tsunesuke Takano; Kouichi Sinzawa; Yoji Yabata, all of Tokyo, Japan

[73] Assignee: Kabushiki Kaisha T An T, Japan

[21] Appl. No.: 789,105

[22] Filed: Dec. 27, 1996

[30] Foreign Application Priority Data

Oct. 22, 1996 [JP] Japan ..... 8-279610

[51] Int. Cl.[6] ..... H01H 13/14

[52] U.S. Cl. ..... 200/530; 220/531; 220/532

[58] Field of Search ..... 200/520, 530, 200/531, 532, 537, 538, 539, 540, 541, 341, 16 R, 16 B, 16 C; 439/699.2

[56] References Cited

U.S. PATENT DOCUMENTS 3,989,912 11/1976 Francke ..... 200/531

5,201,410 4/1993 Tanako et al. ..... 200/531

5,326,952 7/1994 Ipcinski ..... 200/530

5,597,329 1/1997 Tanako et al. ..... 439/699.2

*Primary Examiner*—Khanh Dang

*Attorney, Agent, or Firm*—Nixon & Vanderhye P.C.

[57] ABSTRACT

Switch connecting structures include a housing having an insertion hole, and an operation lever slidably mounted in the housing. The operation lever includes a push member protruding from said housing. A resilient contact plate is carried by the operation lever so as to be slidable therewith. A connection terminal is provided having a resilient clamp portion and a contact plate portion. The contact plate portion is inserted into the insertion hole of the housing and extending therewithin over a range of slidable movement of the operation lever so as to be in contact with the resilient contact plate. In such a manner, the clamp portion is connectable to a bus bar for electrical connection of the switch to a circuit.

6 Claims, 9 Drawing Sheets

SWITCH CONNECTING STRUCTURE

BACKGROUND OF THE INVENTION

I. Field of the Invention

The present invention relates to a switch connecting structure in which a switch, such as a push-button switch, is directly connected to a bus bar formed on an insulated base.

II. Description of the Prior Art

Conventionally, switches were connected to circuits on insulated bases by inserting a female connector of a lead wire having one end soldered to the circuit on the insulated base onto a lead plate of a pre-mounted switch. Such a conventional switch connecting structure requires a large number of work procedures since the switch was first mounted to its support structure, followed by attachment of the female connector to the switch by means of a lead wire. These additional work procedures made assembly of the conventional switch much more time consuming.

SUMMARY OF THE INVENTION

In order to solve the above-mentioned problems, the present invention provides for a switch connecting structure that is able to shorten assembly time and thereby lower labor costs by enabling a switch to be directly attached to a bus bar formed on an insulated base. More specifically, the switch connecting structure of the present invention includes a housing having an insertion hole, and an operation lever slidably mounted in the housing. The operation lever includes a push member protruding from said housing. A resilient contact plate is carried by the operation lever so as to be slidable therewith.

A connection terminal is provided having a resilient clamp portion and a contact plate portion. The contact plate portion is inserted into the insertion hole of the housing and extending therewithin over a range of slidable movement of the operation lever so as to be in contact with the resilient contact plate. In such a manner, the clamp portion is connectable to a bus bar for electrical connection of the switch to a circuit.

These and other aspects and advantages of the present invention will become more clear after careful consideration of the following detailed description thereof.

DESCRIPTION OF THE PREFERRED EMBODIMENT

Figure 1:
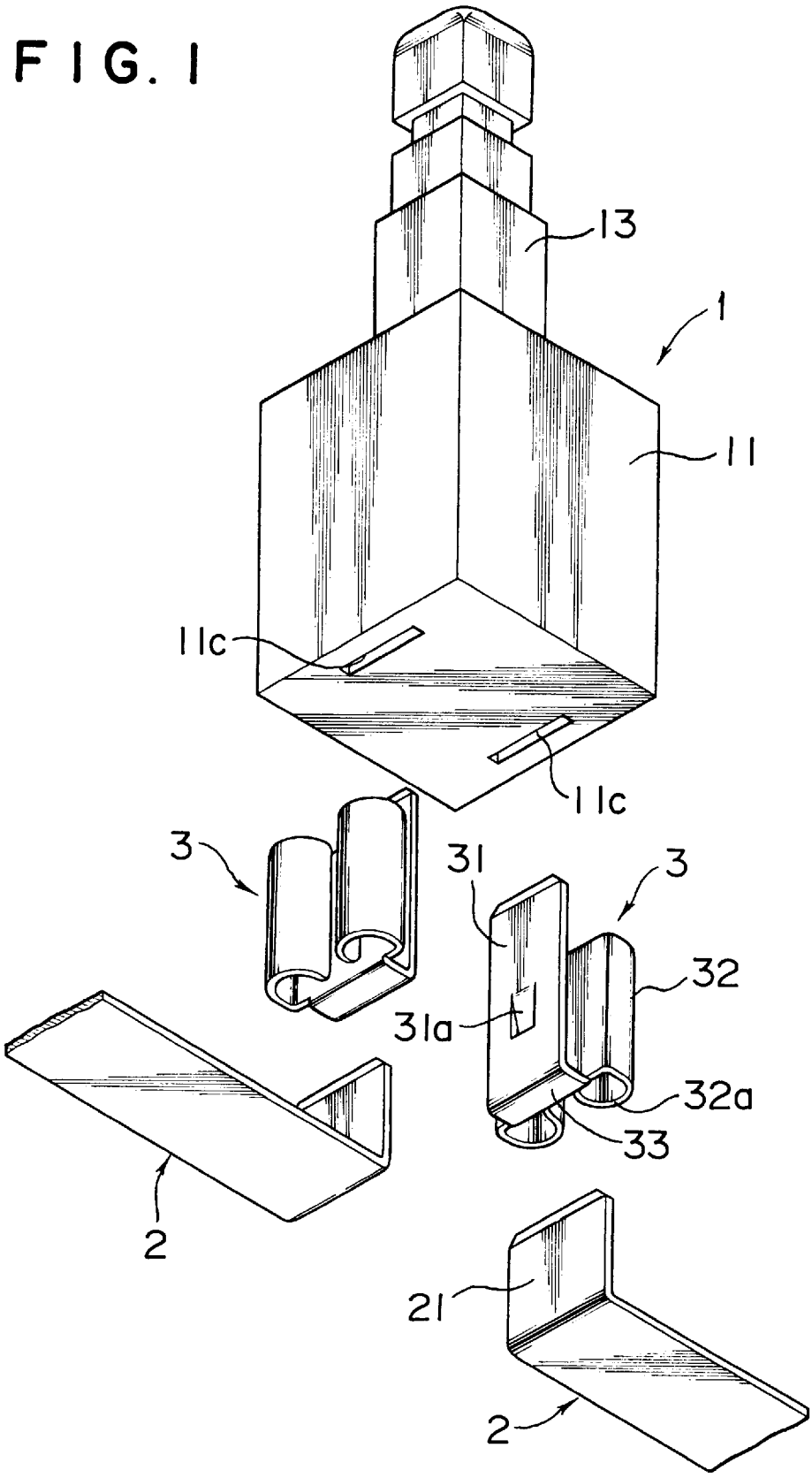
FIG. 1 is an exploded perspective view showing one preferred embodiment of the switch connecting structure of the present invention.
Figure 2:
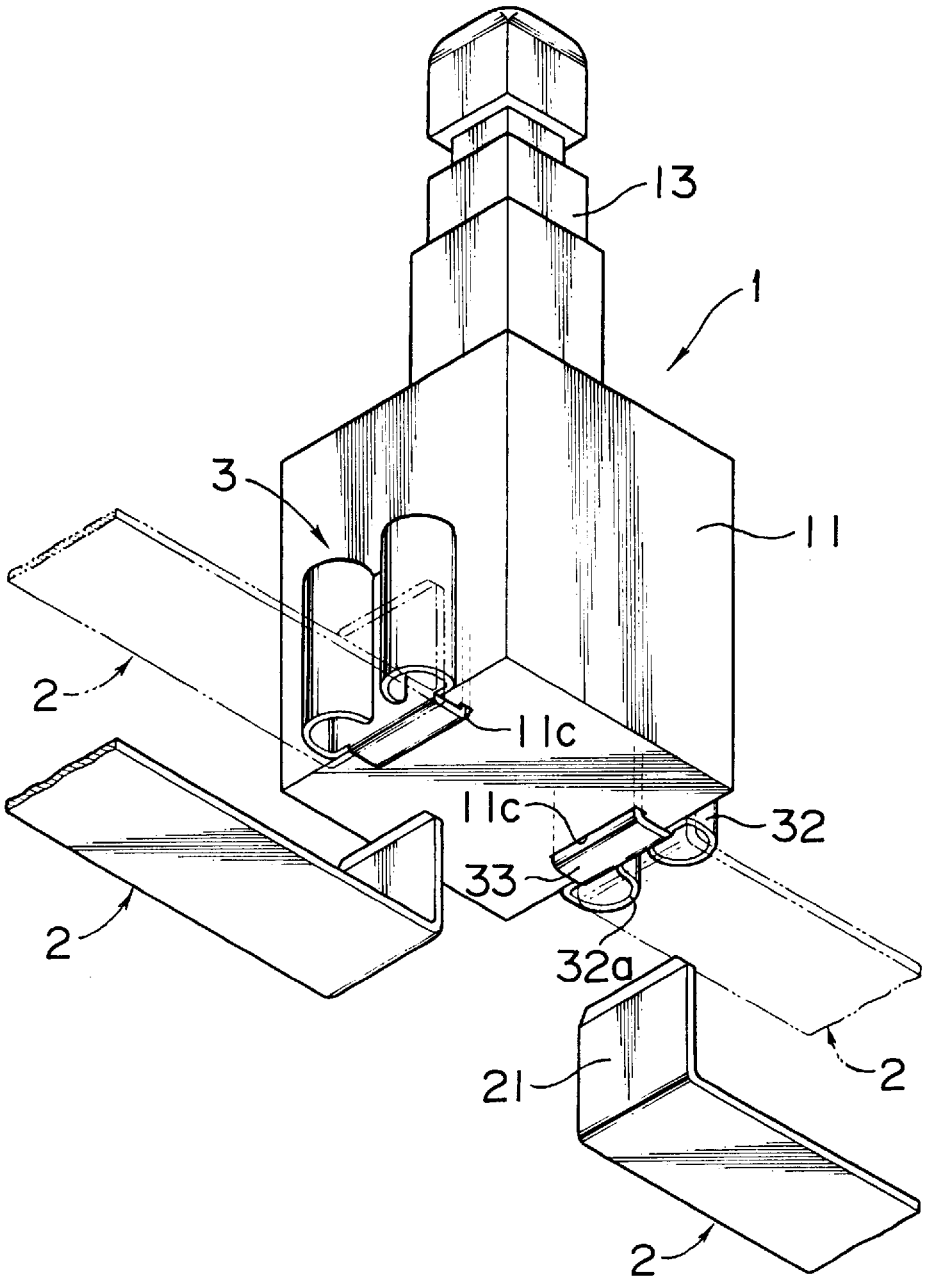
FIG. 2 is a perspective view of the assembled state of the switch connecting structure depicted in FIG. 1.

As shown in accompanying FIGS. 1–4, switch 1 is shown provided with a bottom-walled housing 11. A projection 11*b* projects toward the inside of housing 11 from the center of its bottom wall 11*a*. Mutually facing insertion holes 11*c* and recesses 11*d* are formed in a portion of the wall surface that comprises each insertion hole 11*c*. Grooves lie are continuous with the insertion holes 11*c* and accept terminals 31 of connection terminals 3 to be described later.

A spring 12 has one end inserted onto the projection 11*b*. The other end of spring 12 is inserted into hole 13*a* of push lever 13. The push lever 13 protrudes from through hole 14*a* of cover plate 14 fixed on the open end of the housing 11. A resilient generally U-shaped contact plate 15 is attached to the push lever 13 and has terminal ends which are formed into curved contacts 15*a*.

A pair of bus bars 2 are attached to an insulated base (not shown). The ends of these bus bars 2 are bent at right angles to form blade terminals 21. Connection terminals 3 are inserted into insertion holes 11*c* of the switch 1, and are composed of terminals 31 that fit into grooves 11*e*. Resilient clamps 32 are provided so as to be connectable to blade terminals 21 of the bus bars 2. Couplings 33 connect the terminals 31 and resilient clamps 32.

Tabs 31*a* are formed in the terminal plates 31 that engage with recesses 11*d* formed in the housing 11. The resilient clamps 32 are in the form of eyeglass-shaped terminals 32*a* bent towards the inside into a curved shape on the right and left sides. Blade terminals 21 enter inside terminals 32*a* and are clamped in position thereby. The terminals 31 are locked in position by inserting the terminal plates 31 into insertion holes 11*c* of housing 11 in switch 1. The ends of the terminal plates 31 make contact with the ends of grooves 11*e*, thereby locking the connection terminals 3 in position due to tabs 31*a* of terminals 31 entering recesses 11d. In this state, resilient clamps 32 are fixed along the outer surface of housing 11 with the U-shaped couplings 33 in between. As a result of connection terminals 3 being attached in this manner, switch 1 is fixed to bus bars 2 by inserting terminals 32*a* of resilient clamps 32 onto plate terminals 21 of bus bars 2 fixed on an insulated base (not shown). At the time of this insertion, the interval between blade terminals 21 is naturally arranged to be equal to the interval between resilient clamps 32.

Figure 3:
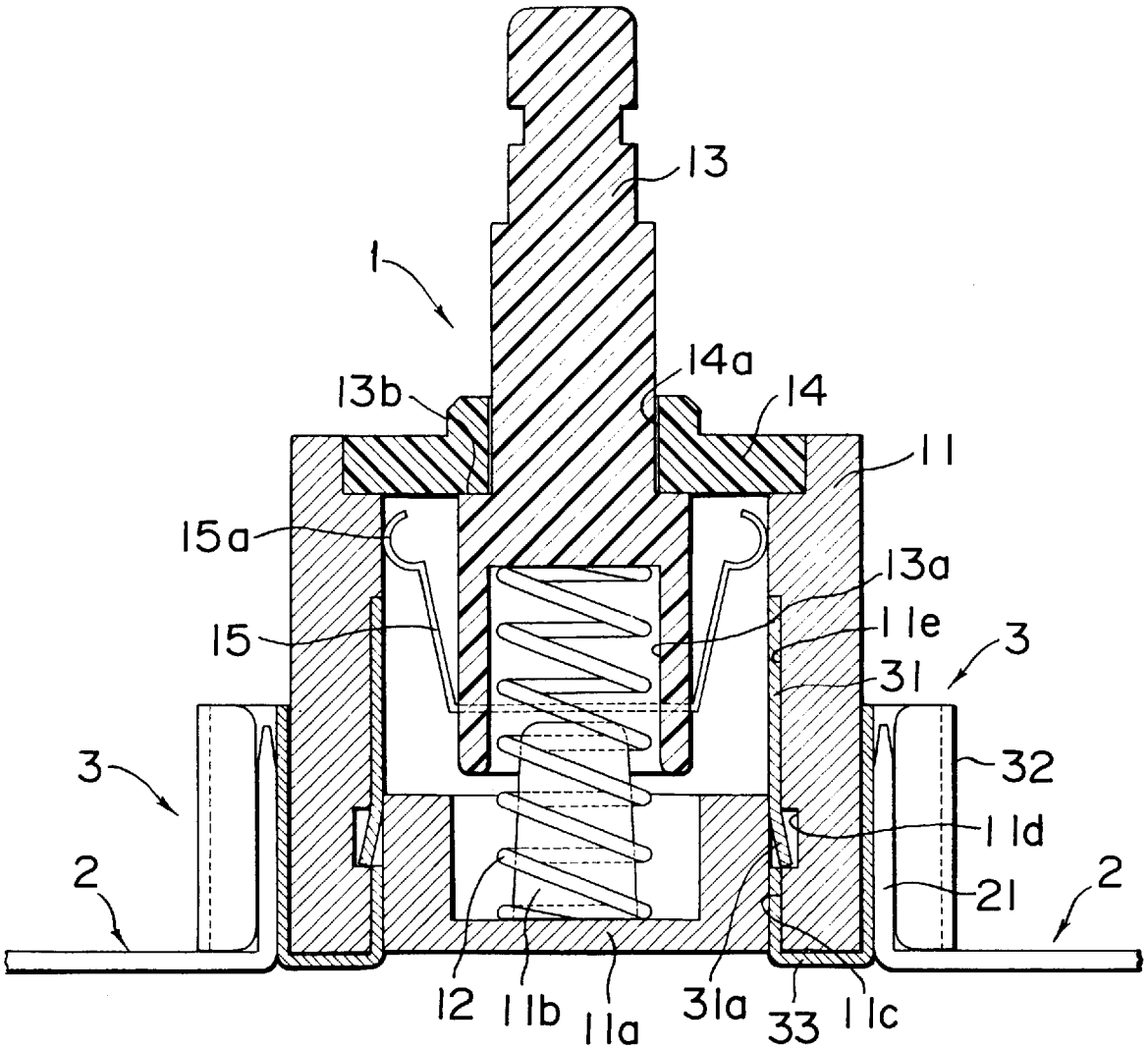
FIG. 3 is a cross-sectional view of the switch in the off state.
Figure 4:
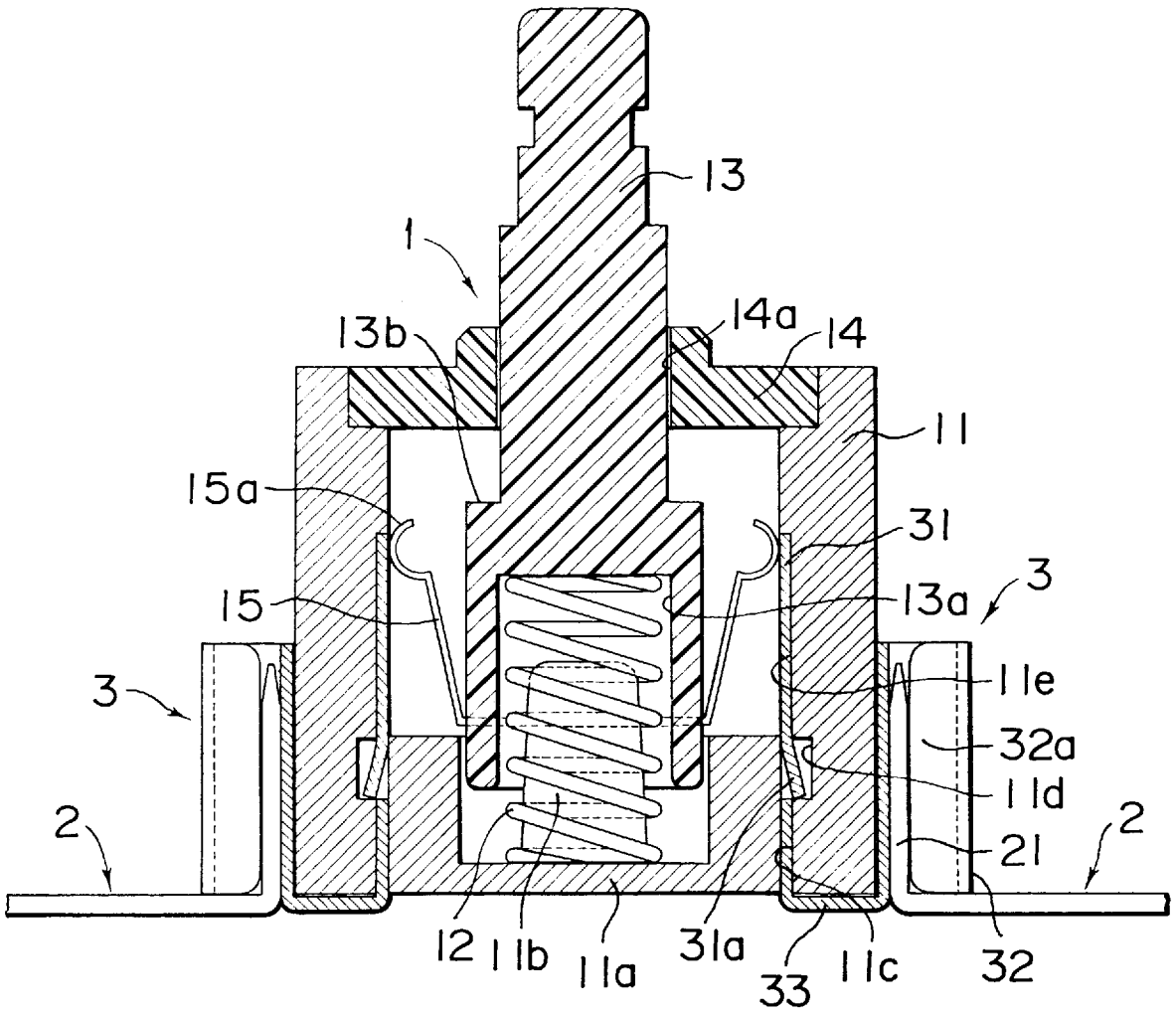
FIG. 4 is a perspective view of the switch in the on state.

The following provides an explanation of the operation of the above-mentioned switch 1. In FIG. 3, lever 13 is pushed up by the spring force of spring 12 and is stopped as a result of ledge 13*b* of the pushing lever 13 making contact with cover plate 14. Thus, since contacts 15*a* of resilient contact plate 15 are positioned away from terminals 31 of connection terminals 3 in this condition, the space between the pair of bus bars 2 is an electrically "off" state. When pushing lever 13 is pushed down in opposition to the spring force of spring 12, contact plate 15 lowers as shown in FIG. 4 causing contacts 15*a* to make contact with terminals 31. Consequently, the space between the pair of bus bars 2 is electrically in an "on" state. If this type of switch 1 was to be installed, for example, on the chassis of an automobile with the door closed, switch 1 would enter the on state when the door was opened.

Although the switch shown in the drawings only enters the on state when pushing lever 13 is pushed, it can be made into a locking push-button switch by incorporating a known locking mechanism. This type of locking push-button switch 1 could be used, for example, as a switch for turning on and off the interior lamp unit installed on the roof of an automobile interior. Furthermore, although blade terminals 21 of bus bars 2 are shown to be inserted from the bottom of housing 11, switch 1 and bus bars 2 may also be connected by inserting from the side of pushing lever 13 as shown in FIG. 6.

Although resilient clamps 32 are positioned along the outside of housing 11 in the above-mentioned embodiment, the ends of the switch can be prevented from being exposed by increasing the width in the horizontal direction of housing 11 (to the left and right in FIGS. 3 and 4), forming holes to contain resilient clamps 32 in the widened portion, and containing resilient clamps 32 in these holes.

Figure 5:
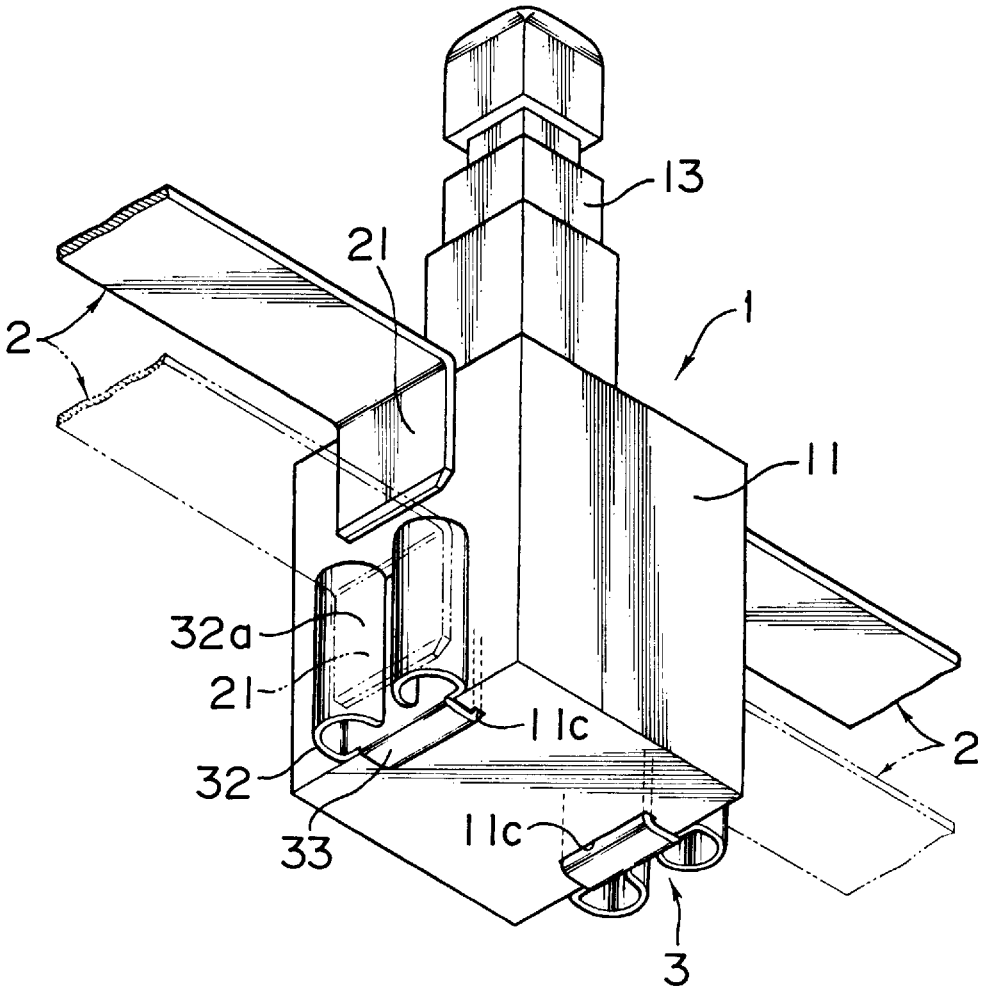
FIG. 5 is a perspective view in which the attachment direction of the bus bars has been changed.
Figure 6:
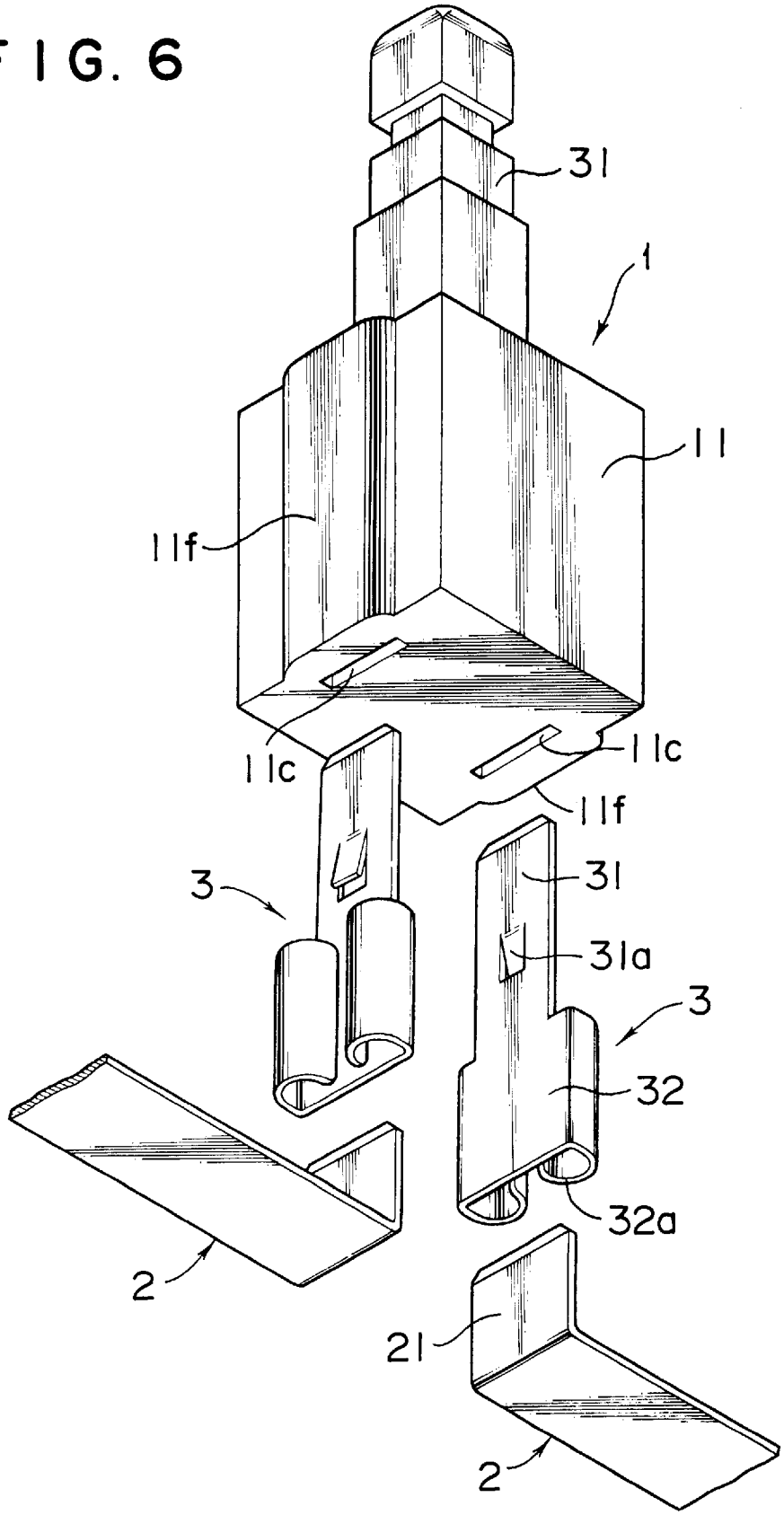
FIG. 6 is an exploded perspective view showing another embodiment of the present invention.
Figure 7:
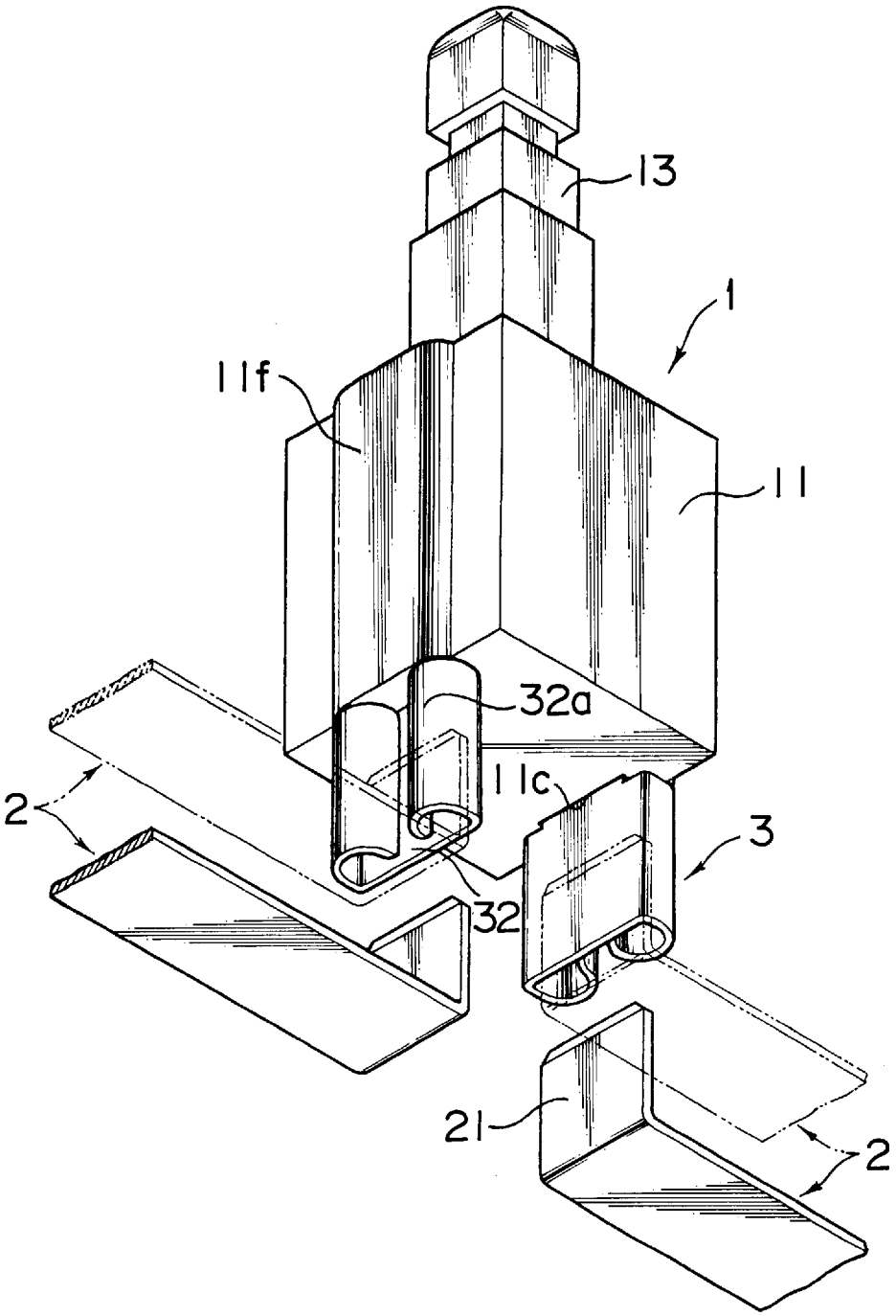
FIG. 7 is an exploded perspective view showing the assembled state of the switch connecting structure shown in FIG. 6;.

FIGS. 6 and 7 depict another embodiment of the present invention. In contrast to the embodiments described above having terminals 31 and resilient clamps 32 bent in the same direction with coupling 33 therebetween, in the embodiment depicted in FIGS. 5 and 7, terminals 31 and resilient clamps 32 are arranged linearly with coupling 33 in between. In addition, in this embodiment, ribs 11*f* are formed on a portion of the outside of housing 11, and a portion of resilient clamps 32 are able to be placed on these ribs 11*f*.

When resilient clamps 32 are placed on the above-mentioned ribs 11*f* in this manner, resilient clamps 32, which protrude from housing 11, are fixed in a stable state. Moreover, this enables the switch to be used even in locations in which the interval between blade terminals 21 of bus bars 2 and housing 11 is long, or the housing 11 and bus bars 2 are in such close proximity that they cannot be attached.

Figure 8:
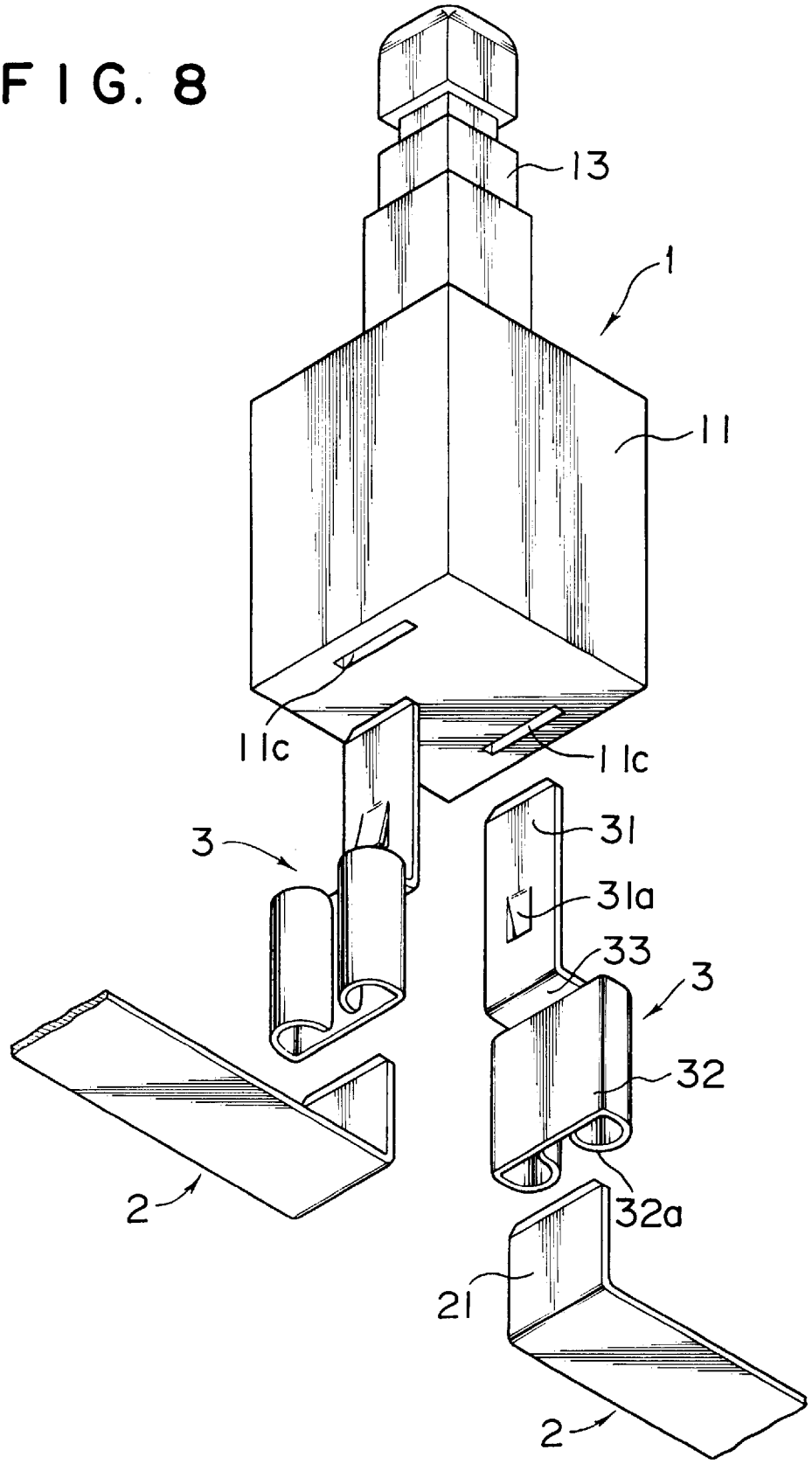
FIG. 8 is an exploded perspective view showing a third embodiment of the present invention.
Figure 9:
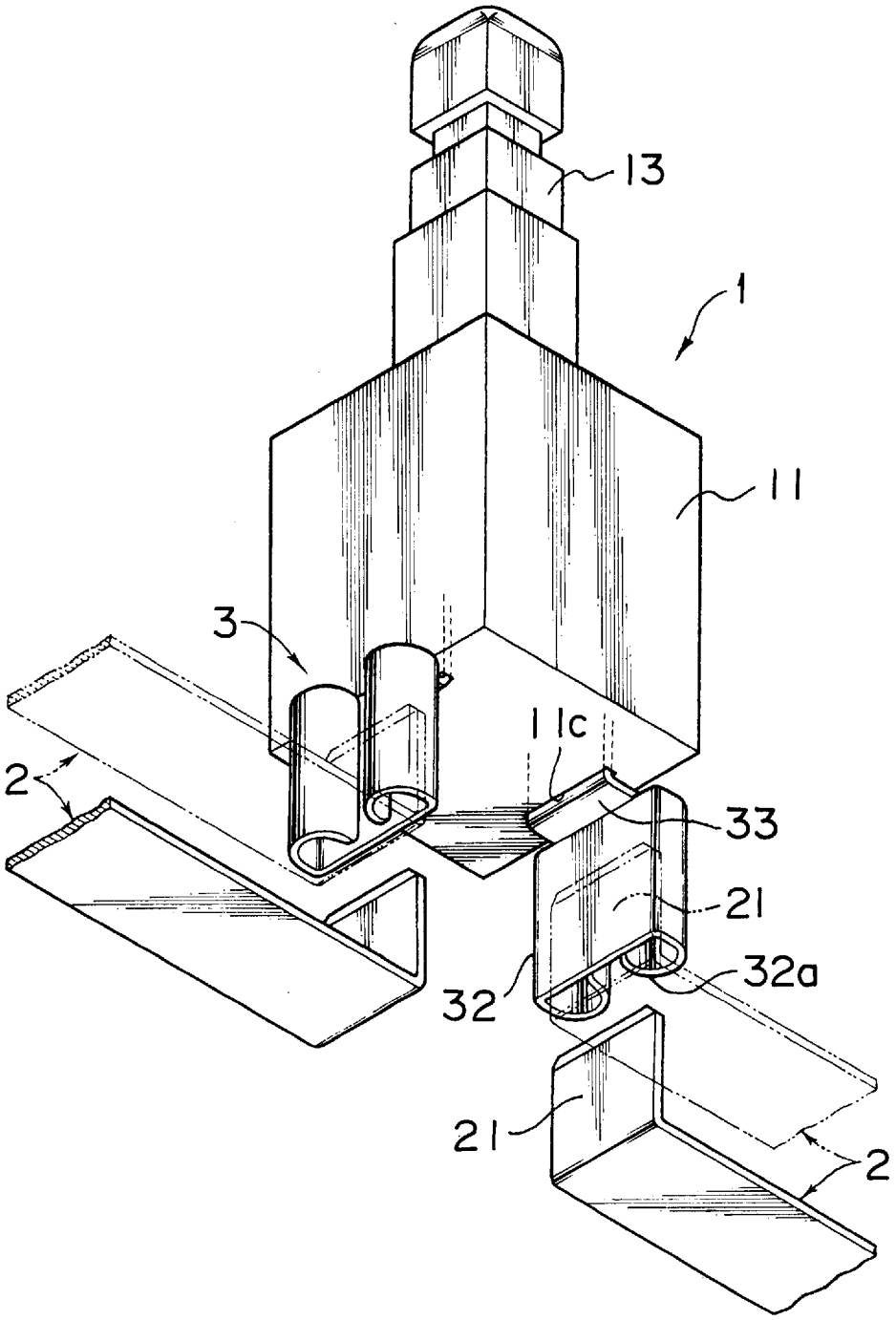
FIG. 9 is an exploded perspective view showing the assembled state of the switch connecting structure shown in FIG. 8.

FIGS. 8 and 9 depict another embodiment of the present invention. In contrast to the above-mentioned embodiment shown in FIGS. 6 and 7 having terminals 31 and resilient clamps 32 formed linearly, in the embodiment of this invention depicted in FIGS. 8 and 9, couplings 33 are bent at a right angle causing terminals 31 and resilient clamps 32 to be offset from each other. In this case, since couplings 33 are placed on the upper surface of housing 11 and second resilient clamps 32 are placed on extensions 11*h*, switch 1 can be fixed to bus bars 2 in a stable state even without ribs 11*f* as in the previous embodiment.

Furthermore, regardless of the shape of connection terminals 3 in each of the above-mentioned embodiments, what is important is that terminal 31 and resilient clamp 32 be formed on one connection terminal 3, so that terminals 31*a* are inserted into housing 11 and serve as switch contacts, and terminals 32*a* of resilient clamps 32 engage and are clamped in blade terminals 21 of bus bars 2.

As has been described above, the structures of this invention allow connection of the switch and the bus bars to be performed without the use of a connecting means such as welding. As a result, the assembly process is shortened and the two components can be disconnected easily. In addition, by forming terminal plates and resilient clamps linearly, the interval between the bus bars and switch can be increased thus enabling variation to be obtained in the manner in which the state is attached. Moreover, by bending the couplings to offset the terminal plates and resilient clamps, said couplings are placed on the housing, thus enabling the connection terminals to be fixed to the switch in a stable manner, and offering the advantage of preventing the switch from being deformed with respect to the bus bars.

We claim:

1. A switch connecting structure comprising:

a housing which includes an insertion hole;

an operation lever slidably mounted in said housing, said operation lever including a push member protruding from said housing;

a resilient contact plate carried by said operation lever so as to be slidable therewith; and a connection terminal including a resilient clamp portion and a contact plate portion, said contact plate portion being inserted into said insertion hole of said housing and extending therewithin over a range of slidable movement of said operation lever so as to be in contact with said resilient contact plate, wherein said clamp portion is connectable to a bus bar for electrical connection of the switch to a circuit.

2. The switch connection of claim 1, wherein said connection terminal includes a coupling for coupling said clamp and contact plate portions to one another and for orienting said resilient clamp portion adjacent an exterior wall section of said housing.

3. The switch connection of claim 1, wherein said clamp and contact plate portions are off-set from one another.

4. The switch connection of claim 1, wherein said clamp and contact plate portions are in-line with one another.

5. The switch connection of claim 1, wherein said housing includes an interior groove for receiving said contact plate portion.

6. The switch connection of claim 1, wherein said housing includes a recess, and wherein said contact plate portion includes a resilient tab extending into said recess for coupling said connection terminal to said housing.

* * * * *